US011143139B2

(12) United States Patent
Kono et al.

(10) Patent No.: US 11,143,139 B2
(45) Date of Patent: Oct. 12, 2021

(54) ENGINE DEVICE

(71) Applicant: HONDA MOTOR CO., LTD., Tokyo (JP)

(72) Inventors: Shohei Kono, Wako (JP); Masashi Kai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 21 days.

(21) Appl. No.: 16/758,931

(22) PCT Filed: Dec. 11, 2017

(86) PCT No.: PCT/JP2017/044444

§ 371 (c)(1),
(2) Date: Apr. 24, 2020

(87) PCT Pub. No.: WO2019/116434

PCT Pub. Date: Jun. 20, 2019

(65) Prior Publication Data

US 2020/0309062 A1 Oct. 1, 2020

(51) Int. Cl.

| | |
|---|---|
| ***F02F 7/00*** | (2006.01) |
| ***F01N 1/02*** | (2006.01) |
| ***F01N 3/28*** | (2006.01) |

(52) U.S. Cl.

CPC ..... *F02F 7/0082* (2013.01); *F01N 1/02* (2013.01); *F01N 3/28* (2013.01)

(58) Field of Classification Search

CPC ... F16M 1/00; F01N 2450/24; F01N 13/1855; F02F 7/0082

See application file for complete search history.

(56) References Cited

U.S. PATENT DOCUMENTS 2,287,399 A * 6/1942 Ware ..... F02F 7/0053 92/149
5,716,145 A * 2/1998 Eidenbock ..... B23D 31/003 29/898.12

(Continued)

FOREIGN PATENT DOCUMENTS

JP H017919 Y2 3/1989
JP H10121959 A 5/1998

(Continued)

OTHER PUBLICATIONS

English translation of International Search Report for International Application No. PCT/JP2017/044444, dated Feb. 6, 2018, 2 pages.

*Primary Examiner* — Anthony Ayala Delgado
(74) *Attorney, Agent, or Firm* — Armstrong Teasdale LLP

(57) ABSTRACT

Provided is an engine device that can enlarge a space inside a case without lowering support stiffness. An engine (2) is attached to a case (11) via support parts (81, 82). A rear lower portion support part (82), which is one of the support parts, includes an attachment rib (11*b*) as a mounting part provided in the case (11) and an attachment bracket (91) fastened to a bottom of a crankcase (46) by a fastening bolt (90) and attached to the attachment rib (11*b*). The fastening bolt (90) penetrates through a through hole (92*a*) provided in the attachment bracket (91) and is screwed into a screw hole (46*e*) formed obliquely inward at a corner of the bottom of the crankcase (46).

6 Claims, 6 Drawing Sheets

(56) References Cited

U.S. PATENT DOCUMENTS

| | | | | |
|---|---|---|---|---|
| 5,965,949 | A * | 10/1999 | Fukuda | F02B 63/04 290/1 A |
| 6,378,468 | B1 * | 4/2002 | Kouchi | F02B 63/04 123/41.56 |
| 10,001,055 | B2 * | 6/2018 | Koyama | F02B 63/048 |
| 10,227,902 | B2 | 3/2019 | Kono | |
| 10,260,456 | B2 * | 4/2019 | Hiranuma | F02B 63/044 |

FOREIGN PATENT DOCUMENTS

| | | | |
|---|---|---|---|
| JP | 2001027127 | A | 1/2001 |
| JP | 3340665 | B2 | 11/2002 |
| JP | 3871829 | B2 | 1/2007 |
| JP | 2017160833 | A | 9/2017 |
| JP | 2017166397 | A | 9/2017 |
| JP | 2017166400 | A | 9/2017 |

* cited by examiner

ENGINE DEVICE

CROSS-REFERENCE TO RELATED APPLICATIONS

This application is a U.S. National Phase Application of PCT/JP2017/044444, filed Dec. 11, 2017, the contents of which are hereby expressly incorporated by reference in their entirety.

TECHNICAL FIELD

The present disclosure relates to an engine device including an engine and a case that accommodates the engine.

BACKGROUND ART

There is a known portable engine power equipment configured such that an engine and a power equipment driven by the engine are accommodated in a case made of synthetic resin and a carrying handle is provided at an upper part of the case (for example, Patent Document 1). In this engine power equipment, a crankcase, a cylinder block and a cylinder head of the engine are covered by a shroud, and a head cover of the engine is exposed via an opening formed in an upper part of the shroud so as to be elastically supported by the carrying handle of the case. Accordingly, when the carrying handle is grasped and the engine power equipment is lifted, the loads of the engine and the power equipment act directly on the carrying handle.

PRIOR ART DOCUMENT (S)

Patent Document(S)

Patent Document 1: JP2001-27127A

SUMMARY OF THE INVENTION

Task to be Accomplished by the Invention

However, the engine power equipment described in Patent Document 1 has the following problems. The crankcase of the engine is divided into a front half and a rear half on a dividing face inclined with respect to an axis of a crankshaft. The front half is formed integrally with the cylinder block and the cylinder head, and the front half and the rear half are joined by bolts. On the other hand, a lower support structure of the engine is configured such that an attachment bracket is joined to a lower part of the rear half of the crankcase by two bolts extending in parallel with the axis of the crankshaft, and the attachment bracket is supported by the case. Therefore, a space for providing the lower support structure is required on a rear side of the engine, and accordingly, a space inside the case may be reduced or the case needs to be enlarged.

In view of such a problem of the prior art, the present invention provides an engine device that can enlarge a space inside a case without lowering support stiffness.

Means for Accomplishing the Task

To achieve such an object, the present invention provides an engine device (1) including: an engine (2); and a case (11) that accommodates the engine, wherein the engine includes a crankcase (46) constituting a lower part thereof and is attached to the case via support parts (81, 82), at least one of the support parts includes a mounting part (11*b*) provided in the case and an attachment bracket (91) fastened to a bottom of the crankcase by a fastening bolt (90) and attached to the mounting part, and the fastening bolt (90) penetrates through a through hole (92*a*) provided in the attachment bracket and is screwed into a screw hole (46*e*) formed obliquely inward at a corner of the bottom of the crankcase.

According to this configuration, the fastening bolt and the attachment bracket are displaced downward, and a space inside the case is enlarged accordingly. Further, since the screw hole is formed at the corner of the bottom of the crankcase, which has high stiffness, supporting stiffness does not decrease.

Preferably, in the above configuration, the crankcase (46) includes a first half (46*c*) and a second half (46*d*) joined to each other by bolts (52) on an interface (46*b*) formed obliquely with respect to a crank axis, and the second half is provided with the screw hole (46*e*), and the screw hole is orthogonal to the interface.

According to this configuration, the direction of the screw hole is orthogonal to the interface like a through hole of a bolt for fastening the second half to the first half is orthogonal thereto, so that the screw hole can be formed easily.

Preferably, in the above configuration, the attachment bracket (91) is attached to the mounting part via a mounting axial member (95, 96) penetrating horizontally through an attachment hole (93*a*) provided in the attachment bracket and a support hole (11*d*) provided in the mounting part (11*b*), and the mounting axial member at least partially overlaps with the fastening bolt when viewed in an axial direction of the fastening bolt (90).

According to this configuration, the load transmitted from the engine to the attachment bracket via the fastening bolt is linearly transmitted to the mounting bolt. Therefore, the bending moment acting on the attachment bracket becomes small, and the bending moment acting on the fastening bolt and the screw hole also becomes small. Accordingly, it is possible to prevent the support stiffness from being lowered.

Preferably, in the above configuration, the mounting part (11*b*) is provided at each of two ends of the mounting axial member (95, 96), the attachment bracket (91) includes two cylindrical parts (93) surrounding a middle part of the mounting axial member between the two ends thereof, and each cylindrical part is supported by the mounting axial member via a rubber bushing (94) provided between an outer circumference of the mounting axial member (95, 96) and an inner circumference of the cylindrical part.

According to this configuration, it is possible to prevent the vibration of the engine from being transmitted to the case.

Preferably, in the above configuration, the through hole (92*a*) is provided in a part of the attachment bracket (91) between the two cylindrical parts (93).

According to this configuration, it is possible to prevent the size of the attachment bracket from increasing.

Preferably, in the above configuration, the mounting axial member (95, 96) includes a mounting bolt (96) and a collar (95) surrounding the mounting bolt.

According to this configuration, it is possible to prevent the rubber bushing from being pressed against the mounting bolt when the mounting bolt is tightened.

Preferably, in the above configuration, the engine device further includes a muffler (61) accommodating an exhaust catalyst (62) and provided in a space defined between the case (11) and a side of the engine (2) where the attachment bracket (91) is attached.

According to this configuration, the muffler accommodating the exhaust catalyst is provided in the space enlarged owing to the above arrangement of the attachment bracket, so that the size of the muffler can be increased. Accordingly, it possible to increase the size of the exhaust catalyst and thereby improve the purification performance of the exhaust gas without reducing the muffling effect of the muffler.

Effect of the Invention

Thus, according to the present invention, it is possible to provide an engine device that can enlarge a space inside a case without lowering support stiffness.

MODE (S) FOR CARRYING OUT THE INVENTION

Figure 1:
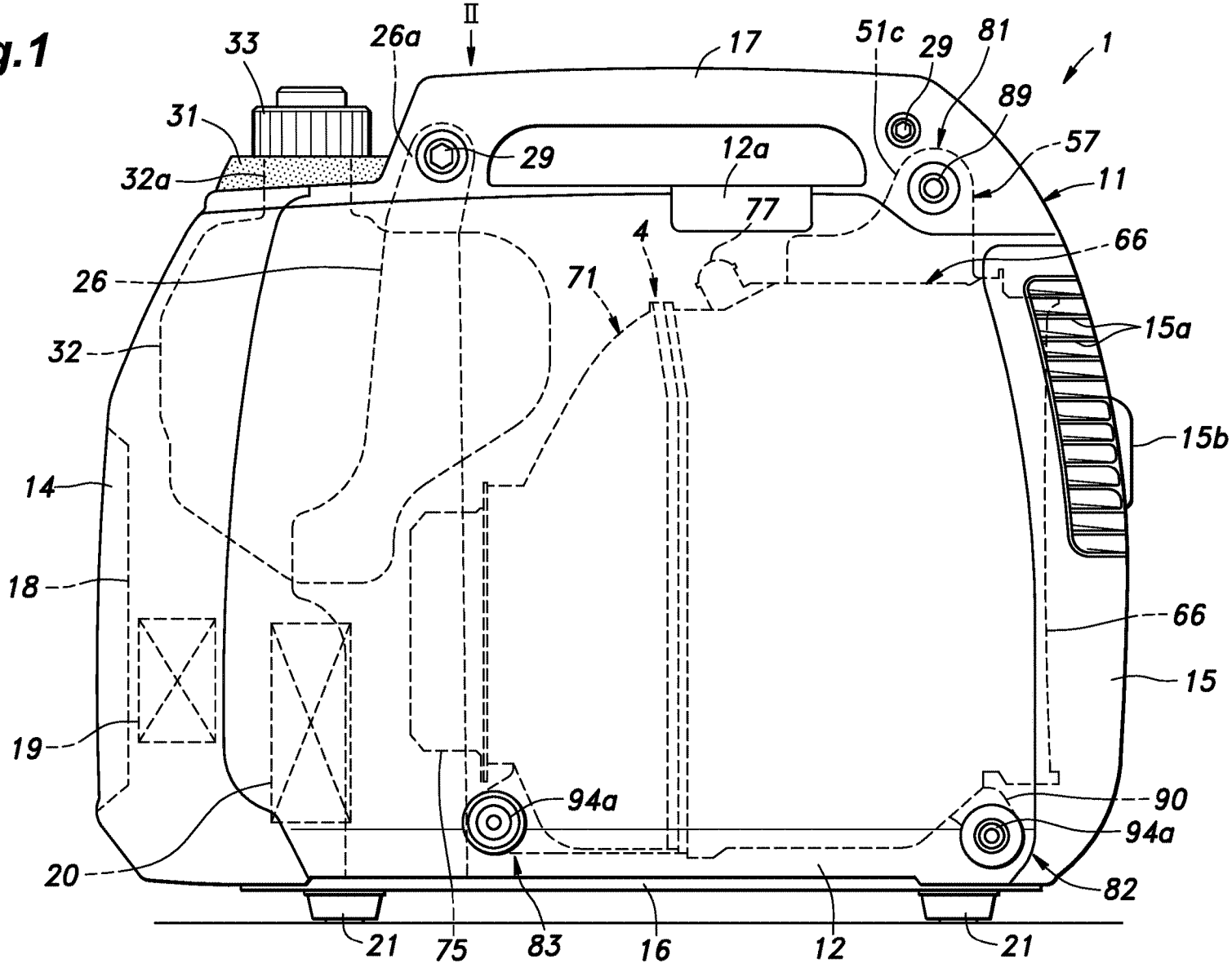
FIG. 1 is a side view of an engine generator according to an embodiment.

In the following, an embodiment of the present invention will be described in detail with reference to the drawings.

As shown in FIGS. 1 to 4, an engine generator 1 includes an engine 2 (see FIGS. 3 and 4) and a generator 3 (see FIGS. 3 and 4) as power equipment driven by the engine 2. The engine generator 1 is engine power equipment that drives the generator 3 by the engine 2 to generate electricity. The engine 2 and the generator 3 compose a power generation unit 4 as a power unit and are housed in a case 11. The case 11 is made of synthetic resin and defines an outline of the engine generator 1. In this sense, the engine generator 1 is an engine device including the engine 2 and the case 11.

The case 11 includes a left side cover 12, a right side cover 13, a front cover 14, a rear cover 15, and an under cover 16. The left side cover 12 and the right side cover 13 are integrally joined to each other, and a carrying handle 17 for carrying the engine generator 1 is formed in the upper parts of the left side cover 12 and the right side cover 13. A lattice-like reinforcement rib 17*a* is formed inside the carrying handle 17 (see FIGS. 3 and 4). The left side cover 12 is provided with an ignition plug replacement lid 12*a* (see FIGS. 1 and 2), and the right side cover 13 is provided with a maintenance lid 13*a* (see FIG. 2). The front cover 14 is provided with an operation panel 18, a control unit 19 arranged behind the operation panel 18 so as to control the operations of the engine 2 and the generator 3, and an inverter unit 20 arranged behind the control unit 19 so as to control the output frequency of the generator 3. Further, a lower part of the front cover 14 is provided with an air introduction opening 14*a* (see FIG. 3) for introducing a cooling air and a fresh air, which is supplied to the engine 2, into the case 11. The rear cover 15 is provided with a cooling air discharge opening 15*a* for discharging the cooling air from the case 11 and an exhaust gas discharge opening 15*b* for discharging the burned gas of the engine 2. The under cover 16 is provided with four rubber support legs 21 that abut against the ground or the floor when the engine generator 1 is placed thereon.

Figure 3:
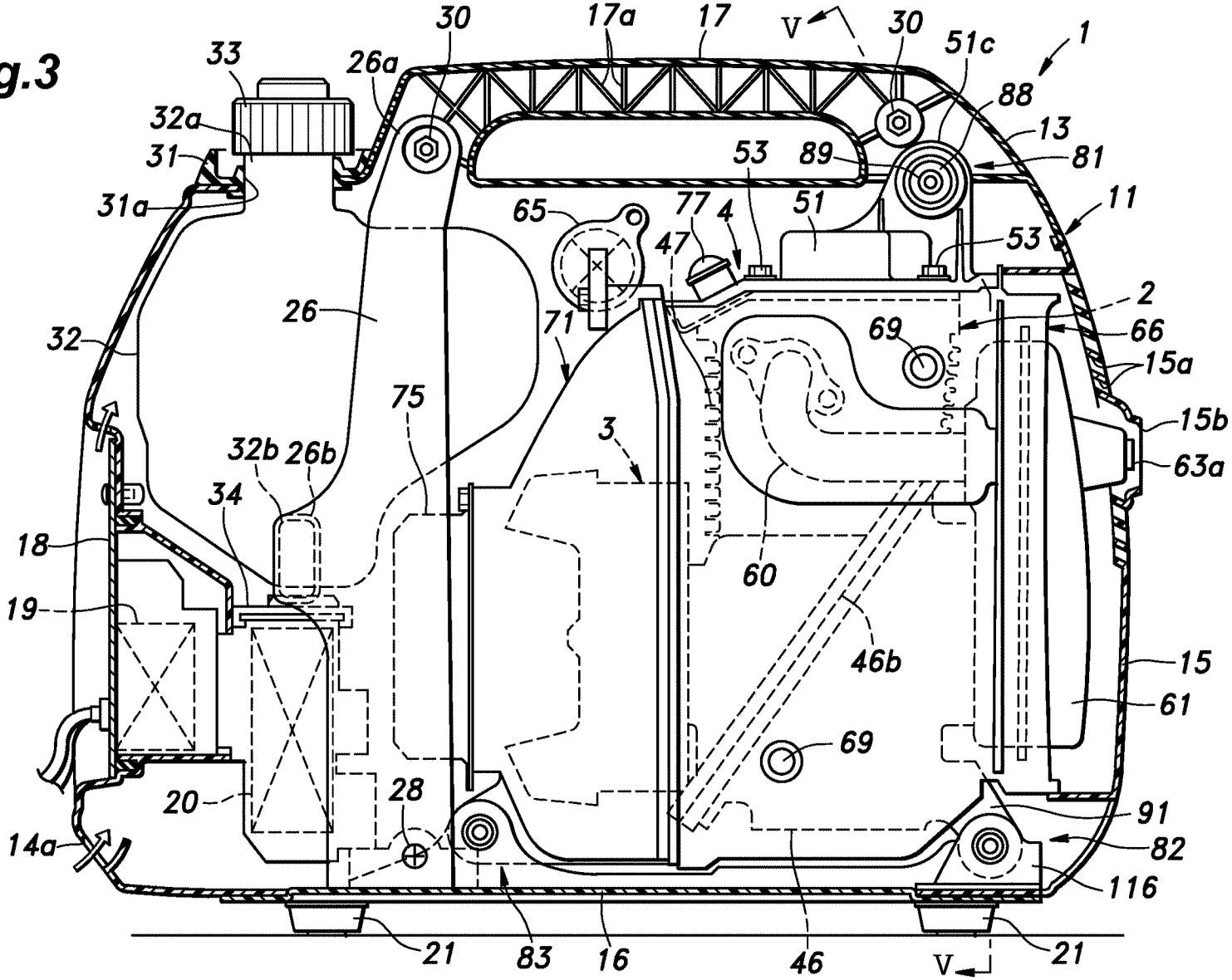
FIG. 3 is a side view showing the inside of the engine generator with a case cut off along a line IV-IV of FIG. 2.

Left and right reinforcement frames 26 (only the left reinforcement frame 26 is shown in FIGS. 1 and 3) made of FRP are provided at the front of the case 11. Each reinforcement frame 26 is formed in an inverted L shape. Lower end of each reinforcement frame 26 is fixed to a lateral surface of the under cover 16 by a bolt 28. Each reinforcement frame 26 extends upward and inward in the lateral direction from the lower end thereof along an inner surface of the corresponding left and right side covers 12, 13. An upper end of each reinforcement frame 26 is provided with an attachment part 26*a* that bends upward. The left and right reinforcement frames 26 have a gate-like shape as a whole, and are fastened together by screwing a bolt 29 inserted from a side of the left side cover 12 into an embedded nut 30 of the right side cover 13 in a state where the attachment parts 26*a* are opposed to each other and interposed between the left side cover 12 and the right side cover 13 at the front of the carrying handle 17.

As shown in FIG. 3, a rubber tubular seal member 31 is attached to a portion where upper surfaces of the left side cover 12, the right side cover 13, and the front cover 14 are joined together. A fuel port 32*a* of a fuel tank 32 arranged above the inverter unit 20 penetrates the seal member 31 from the bottom to the top, and is closed by a detachable cap 33. Protrusions 32*b* provided on both left and right side surfaces of the fuel tank 32 are loosely fitted to fuel tank support parts 26*b* formed on the left and right reinforcement frames 26, respectively. Thereby, the fuel tank 32 is positioned so as not to vibrate. A rubber lower part vibration proof member 34 provided on an upper surface of the inverter unit 20 is opposed to a lower surface of the fuel tank 32 with a small gap. When the fuel tank 32 supplied with fuel expands and is deformed downward due to a load, the lower surface of the fuel tank 32 abuts against an upper surface of the lower part vibration proof member 34, so that the load of the fuel tank 32 is supported by the inverter unit 20.

Thus, the fuel tank 32 is interposed laterally between the left side cover 12 and the right side cover 13 so as to be supported by the left side cover 12 and the right side cover 13. Therefore, the fuel tank 32 can be attached/detached by separating the left side cover 12 and the right side cover 13. Moreover, the fuel tank 32 is surrounded by the left and right reinforcement frames 26, so that the fuel tank 32 can be protected from an impact applied from the outside. The left and right reinforcement frames 26 do not cover the entire engine generator 1, so that the weight is not significantly increased.

Figure 2:
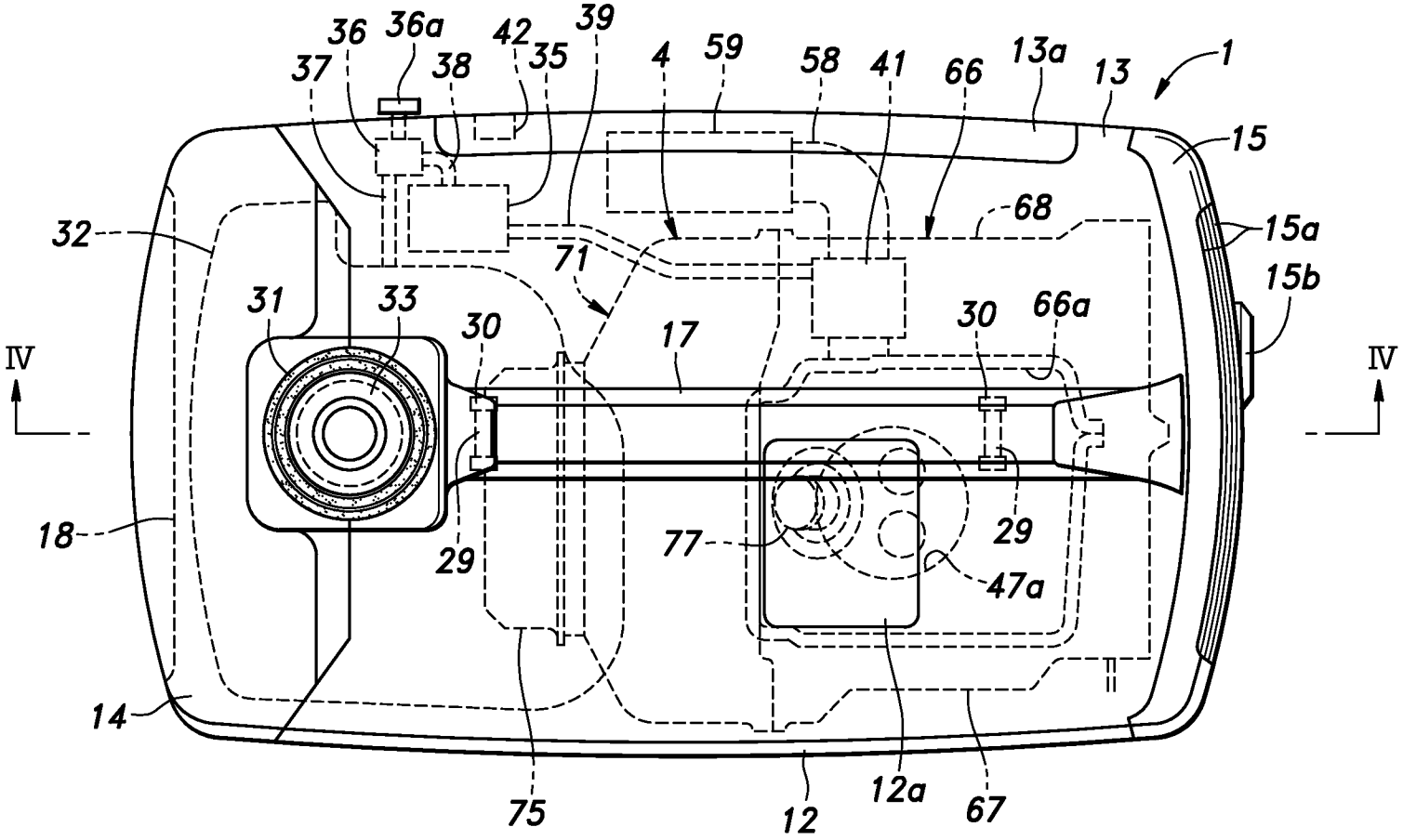
FIG. 2 is a top view along an arrow II of FIG. 1.

As shown in FIG. 2, an electric fuel pump 35 for supplying fuel in the fuel tank 32 to the engine 2 is provided on an inner surface of an upper portion of the right reinforcement frame 26. A fuel cock 36 that shuts off fuel to be supplied to the engine 2 and an engine switch 42 are provided on a lower outer surface of the right reinforcement frame 26. An operation knob 36*a* to open/close the fuel cock 36 penetrates the right side cover 13 so as to be exposed to the outside. Thus, the fuel pump 35 and the fuel cock 36 are supported by using the right reinforcement frame 26, so that a special support member is not required and the number of parts is reduced. Moreover, the fuel supply elements such as the fuel tank 32, the fuel pump 35, the fuel cock 36, and the like are collectively supported by the left and right reinforcement frames 26 instead of the left and right side covers 12, 13. Therefore, the left and right side covers 12, 13 can be easily detached when the maintenance of the fuel supply elements is performed.

A fuel tube 37 that supplies fuel to the fuel cock 36 is connected to the bottom of the fuel tank 32, a fuel tube 38 that supplies fuel to the fuel pump 35 is connected to the fuel cock 36, and a fuel tube 39 that supplies fuel to a carburetor 41 arranged at a right side surface of a cylinder head 50 of the engine 2 is connected to the fuel pump 35. A pulsation of an internal pressure of a crankcase of the engine 2 is transmitted to a diaphragm inside the fuel pump 35, so that the fuel pump 35 operates.

Figure 4:
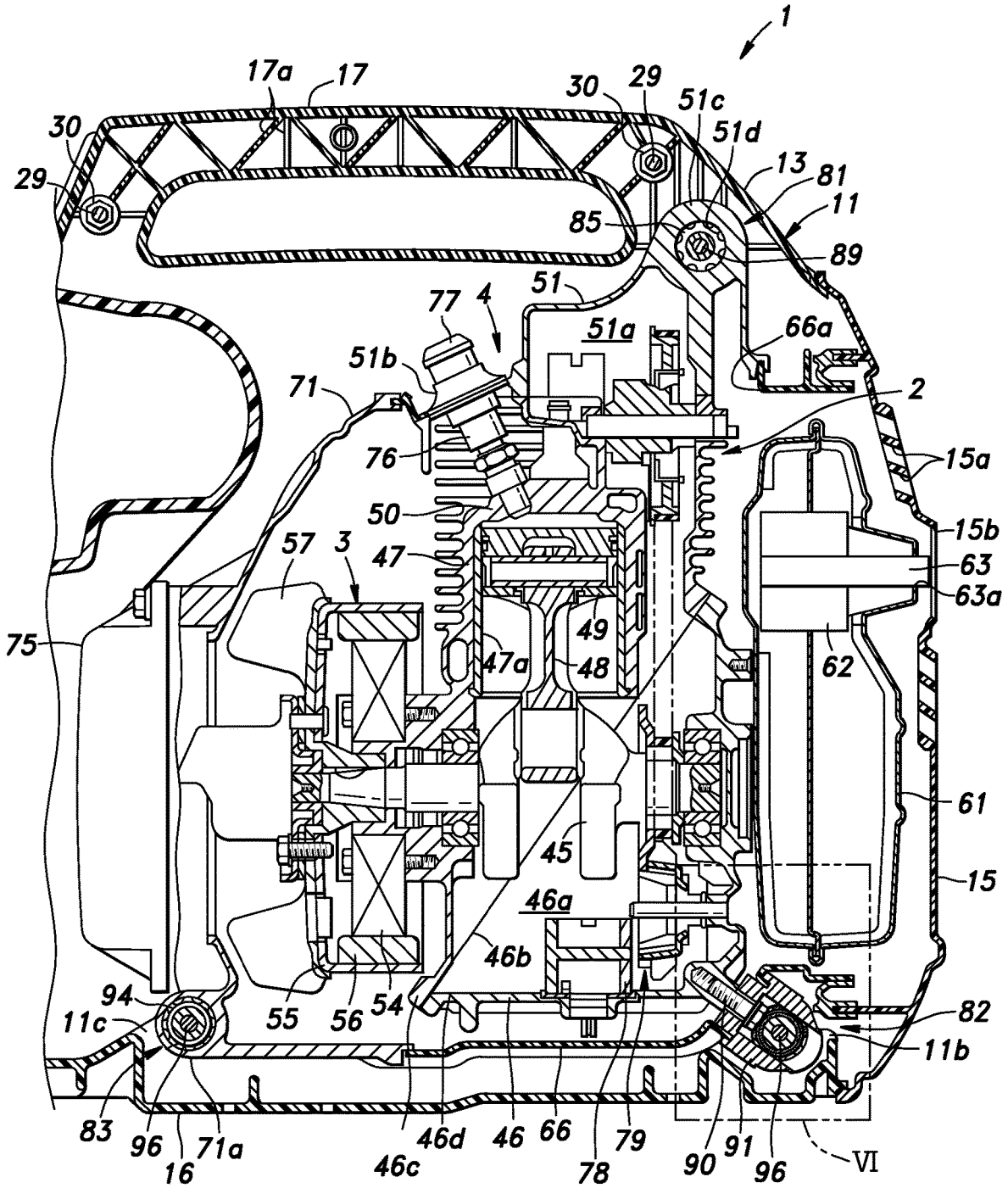
FIG. 4 is a sectional view taken along a line IV-IV of FIG. 2.
Figure 5:
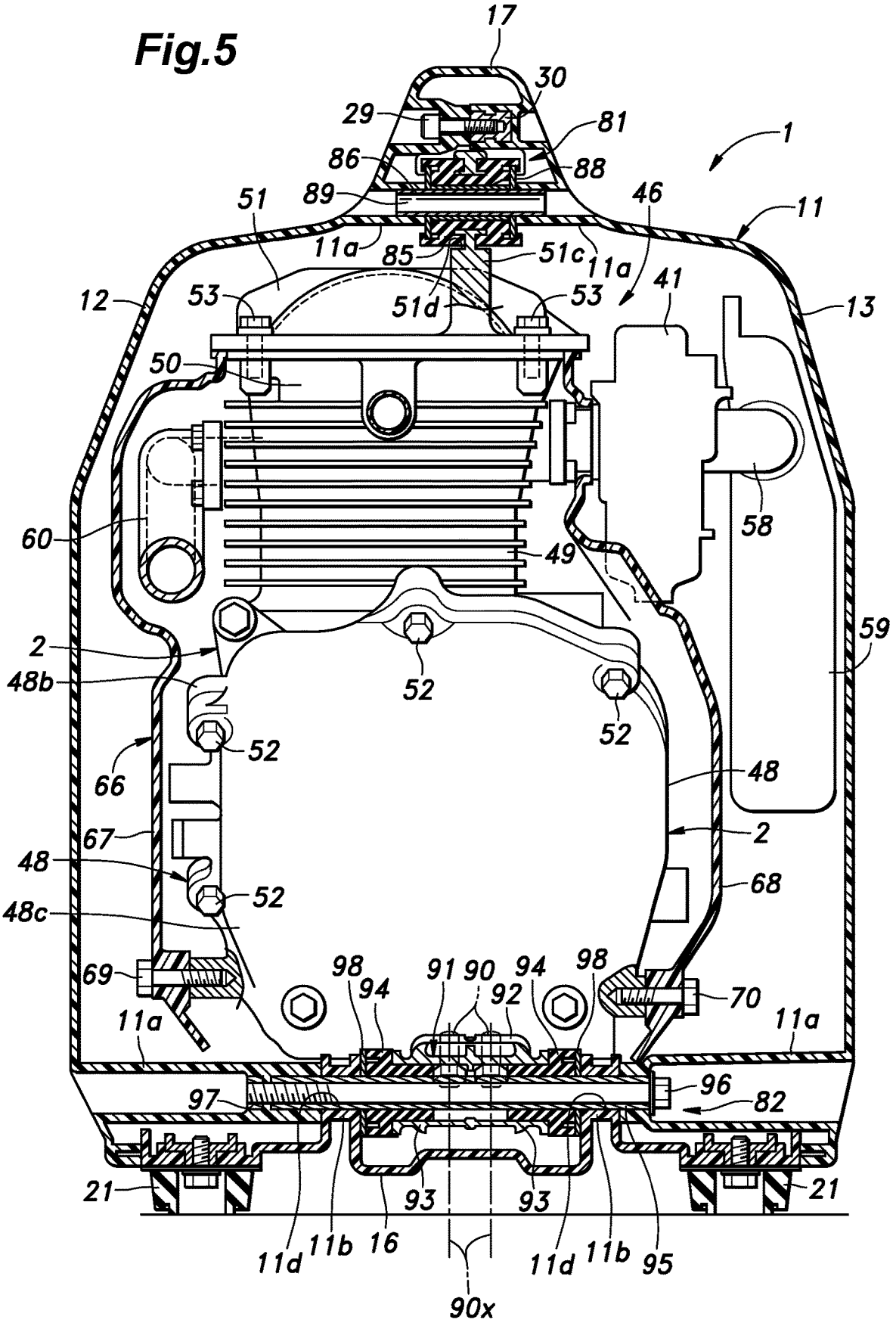
FIG. 5 is a sectional view showing the back of an engine along a line V-V of FIG. 3.

Next, the structure of the power generation unit 4 will be described. As shown in FIGS. 4 and 5, the engine 2 consists of a four-cycle single cylinder engine that arranges a crank axis in the fore and aft direction and a cylinder axis vertically. A crankcase 46 defines a crank chamber 46*a* for accommodating a crankshaft 45 and rotatably supports the crankshaft 45. The crankcase 46 constitutes a lower part of the engine 2. A cylinder block 47 defines a cylinder 47*a* having a lower end communicating with the crank chamber 46*a*. A piston 49 is slidably provided in the cylinder 47*a* and is connected to the crankshaft 45 via a connecting rod 48. An upper end of the cylinder 47*a* is closed by a cylinder head 50, and a valve actuation chamber 51*a* is formed between a head cover 51 and the cylinder head 50.

The crankcase 46 has a two-part structure and includes an upper half 46*c* that mainly constitutes a front half and a lower half 46*d* that mainly constitutes a rear half. The upper half 46*c* and the lower half 46*d* are joined to each other by bolts 52 on an interface 46*b* which is inclined rearward and upward by about 50° with respect to the axis of the crankshaft 45. The upper half 46*c* of the crankcase 46 is integrally formed with the cylinder block 47 and the cylinder head 50, and rotatably supports a front end side of the crankshaft 45 via a ball bearing. The lower half 46*d* of the crankcase 46 rotatably supports a rear end side of the crankshaft 45 via a ball bearing.

A lower part of the crank chamber 46*a* defines an oil reservoir. An oil level sensor 78 is attached to a bottom wall of the crankcase 46. A centrifugal governor 79 for speed control is attached to a rear wall of the crankcase 46 behind the oil level sensor 78. The centrifugal governor 79 is provided with a rotating disk rotatably supported by a support shaft fixed to an inner surface of the lower half 46*d* of the crankcase 46, and a driven gear and a lubricating oil splashing blade are integrally formed on an outer circumference of the rotating disk.

The head cover 51 includes an ignition plug attachment/detachment hole 51*b*, and is detachably joined to the cylinder head 50 by four bolts 53 (see FIG. 5).

As shown in FIG. 4, the generator 3 consists of an outer-rotor type generator provided in a cantilever manner on a shaft end of the crankshaft 45 protruding forward from the crankcase 46. The generator 3 includes a stator composed of a coil 54 fixed to a front surface of the crankcase 46 and a rotor composed of a permanent magnet 56 fixed to an inner circumferential surface of a flywheel 55 fixed to the crankshaft 45. The permanent magnet 56 is opposed to the outer circumferential surface of the coil 54. A cooling fan 57 is coaxially fixed to a front surface of the flywheel 55.

As shown in FIGS. 2 and 5, an air cleaner 59 connected to the carburetor 41 by an intake pipe 58 is arranged in front of the carburetor 41. As shown in FIGS. 3 and 5, a front end of an exhaust pipe 60 extending rearward is connected to a left side surface of the cylinder head 50 of the engine 2, and a box-shaped muffler 61 is connected to a rear end of the exhaust pipe 60. As shown in FIG. 4, the muffler 61 internally defines an expansion chamber for silencing, and accommodates an exhaust catalyst 62 for purifying exhaust gas. The muffler 61 is arranged behind the engine 2 such that an outlet opening 63*a* of an outlet pipe 63 extending rearward from the exhaust catalyst 62 is opposed to the exhaust gas discharge opening 15*b* of the rear cover 15. The muffler 61 is fixed to a rear surface of the engine 2 by bolts.

As shown in FIG. 5, a shroud 66, which is made of synthetic resin, covers the engine 2. The shroud 66 includes a left shroud half 67 and a right shroud half 68. The left shroud half 67 is fastened to left side surfaces of the crankcase 46 and the cylinder block 47 of the engine 2 by two bolts 69 (see FIGS. 3 and 5). The right shroud half 68 is fastened to right side surfaces of the crankcase 46 and the cylinder block 47 of the engine 2 by two bolts 70 (only one bolt 70 is shown in FIG. 5).

As shown in FIG. 4, the shroud 66 has openings on a front surface and a rear surface thereof. An outer circumference of the muffler 61 is fitted to the opening on the rear surface of the shroud 66 with a gap therebetween. A fan cover 71 made of die-cast aluminum is fitted to the shroud 66 so as to cover the opening on the front surface of the shroud 66. The fan cover 71 is fastened to the cylinder head 50 and the crankcase 46 of the engine 2 by bolts, and covers the generator 3 and the cooling fan 57.

A recoil starter 75 is fixed to an opening formed at a front end of the fan cover 71 by bolts. The recoil starter 75 includes a reel, an operation cable, and a driving member. The reel is rotatably supported by a recoil starter cover. One end side of the operation cable is wound around the reel, and another end side of the operation cable penetrates through the right reinforcement frame 26 and the right side cover 13. The driving member is provided on the reel and detachably engaged with a driven member integrated with the cooling fan 57. When the operation cable is pulled and the reel is rotated, the driving member is engaged with the driven member so as to rotate the cooling fan 57, and thereby the crankshaft 45 connected to the cooling fan 57 via the flywheel 55 is cranked, so that the engine 2 can be started.

When the engine 2 is started, the cooling fan 57 provided on the flywheel 55 of the generator 3 rotates in the shroud 66. Due to the negative pressure generated by the rotation of the cooling fan 57, the outside air passes through the air introduction opening 14*a* (see FIG. 3) of the front cover 14 and is introduced into the case 11 as cooling air. The cooling air cools the generator 3, the engine 2, and the muffler 61 that are housed inside the fan cover 71 and the shroud 66. Thereafter, the cooling air is discharged to the outside of the case 11 from the cooling air discharge opening 15*a* of the rear cover 15.

As shown in FIGS. 2 and 4, upper parts of the left shroud half 67 and the right shroud half 68 are provided with connection parts connected with the fan cover 71, and the connection parts are provided with a rectangular opening 66*a* surrounded by the upper parts thereof. The head cover 51 of the engine 2 protrudes to the outside of the shroud 66 via the opening 66*a*. The head cover 51 is provided with the ignition plug attachment/detachment hole 51*b* into which an ignition plug 76 is inserted. The ignition plug attachment/detachment hole 51*b* is closed by a detachable plug cap 77. An ignition coil 65 (see FIG. 3) is provided at an upper end of the fan cover 71 adjacent to the ignition plug 76.

As shown in FIGS. 1 and 2, the plug cap 77 is opposed to the ignition plug replacement lid 12*a* of the left side cover 12, so that the maintenance of the ignition plug 76 can be easily performed by simply opening the ignition plug replacement lid 12*a* and removing the plug cap 77. Further, when the left side cover 12 and the right side cover 13 are detached, the maintenance of the valve actuation mechanism covered by the head cover 51 (for example, the adjustment of a tappet clearance) can be easily performed by detaching the head cover 51 exposed from the shroud 66 without detaching the left shroud half 67 and the right shroud half 68.

As shown in FIGS. 3 to 5, the power generation unit 4 is attached to the case 11 via three support parts of an upper portion support part 81, a rear lower portion support part 82, and a front lower portion support part 83. The upper portion support part 81 attaches an upper portion of the engine 2 to a rear part of the carrying handle 17 of the case 11. The rear lower portion support part 82 attaches a rear lower portion of the engine 2 to a rear part of the under cover 16 of the case 11. The front lower portion support part 83 attaches a front lower portion of the fan cover 71 to a front part of the under cover 16 of the case 11.

First, the upper portion support part 81 will be described. A support plate 51*c* extending in the fore and aft direction protrudes on an upper surface of the head cover 51 of the engine 2. A pair of left and right rubber bushings 85 are fitted to a circular support hole 51*d* formed in the center of the support plate 51*c*, and a collar 86 is inserted into the pair of left and right rubber bushings 85. In a state where washers 88 are arranged at both ends of the pair of left and right rubber bushings 85, both ends of a connecting pin 89 penetrating through the washers 88 and the collar 86 are fitted to a pair of attachment bosses 11*a* as mounting parts (see FIG. 5) formed on the left side cover 12 and the right side cover 13 at the rear of the carrying handle 17. Thereby, the support plate 51*c* of the head cover 51 is elastically supported by the case 11 via the rubber bushings 85.

Figure 6:
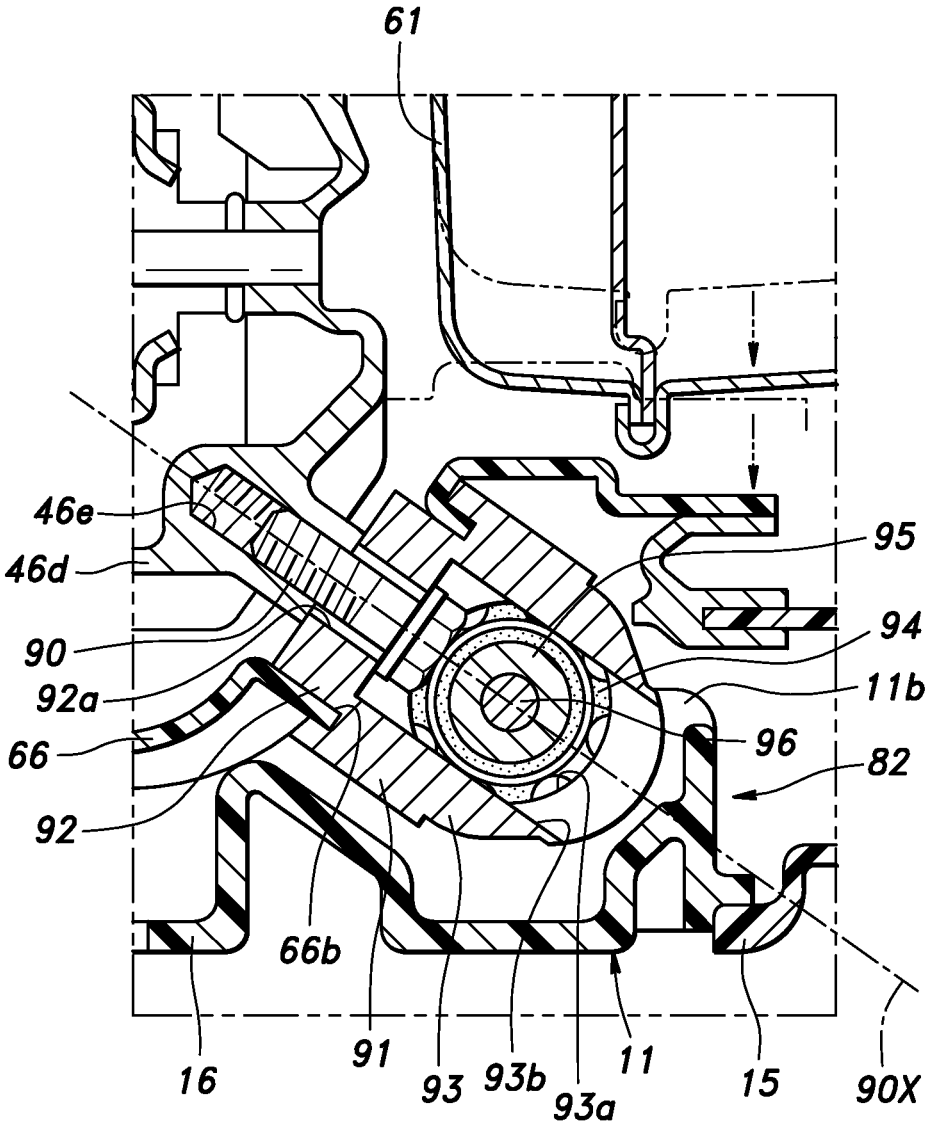
FIG. 6 is an enlarged view of a part VI of FIG. 4.

Next, the rear lower portion support part 82 will be described. As shown in FIGS. 5 and 6, two screw holes 46*e* with bottoms are formed at a rear corner of a bottom of the crankcase 46 of the engine 2. The two screw holes 46*e* are parallel to each other and formed obliquely inward so as to have an upward and forward inclination angle of about 40°. An attachment bracket 91 is fixed to the rear corner of the bottom of the crankcase 46 of the engine 2 by two fastening bolts 90 screwed into the screw holes 46*e*. The two fastening bolts 90 have mutually parallel axes 90X orthogonal to the interface 46*b* (see FIG. 4) of the crankcase 46. That is, the screw holes 46*e* are orthogonal to the interface 46*b* like insertion holes of the bolts 52 for fastening the lower half 46*d* of the crankcase 46 to the upper half 46*c* thereof are orthogonal to the interface 46*b*, so that the screw holes 46*e* can be formed easily.

The attachment bracket 91 includes a main part 92 having two through holes 92*a* through which the fastening bolts 90 penetrate and two cylindrical parts 93 extending obliquely downward and rearward from the main part 92 and protruding to the outside of the shroud 66 from an opening 66*b* formed in a rear lower part of the shroud 66. Each of the cylindrical parts 93 defines an attachment hole 93*a* having an axis extending laterally. The attachment bracket 91 supports the shroud 66 by holding an edge of the opening 66*b* of the shroud 66 by the cylindrical parts 93. The two cylindrical parts 93 are separated by a notch 93*b* provided on the axes 90X of the fastening bolts 90. The two cylindrical parts 93 are integrated with each other on a side of the main part 92, namely, on a side excluding the notch 93*b*. The notch 93*b* has a size to allow penetration of the fastening bolts 90 and entry of a tool that engages with the heads of the fastening bolts 90 when the fastening bolts 90 are attached/detached. That is, the two through holes 92*a* are provided in a part of the main part 92 corresponding to the notch 93*b* (a part of the main part 92 between the two cylindrical parts 93). Accordingly, it is possible to prevent the size of the attachment bracket 91 from increasing. A pair of left and right cylindrical rubber bushings 94 are fitted to the cylindrical parts 93 such that a part of each rubber bushing 94 in the axial direction is inserted into each cylindrical part 93.

On a lower rear side of the case 11, a pair of left and right attachment ribs 11*b* as mounting parts are formed so as to protrude upward from a rear upper surface of the under cover 16. A collar 95 is inserted into support holes 11*d* provided in the pair of attachment ribs 11*b* so that both ends of the collar 95 are supported by the support holes 11*d*. The pair of rubber bushings 94 are interposed between a pair of left and right washers 98 and supported on an outer circumference of a middle portion of the collar 95. A mounting bolt 96, which is inserted from the attachment boss 11*a* formed in the right side cover 13, penetrates through the collar 95. The mounting bolt 96 is fastened to an embedded nut 97 provided in the attachment boss 11*a* formed in the left side cover 12. Accordingly, the attachment bracket 91 exposed from the shroud 66 is elastically supported by the under cover 16 via the rubber bushings 94. Thereby, it is possible to prevent the vibration of the engine 2 from being transmitted to the case 11. Further, the collar 95 is provided inside the rubber bushings 94, and the mounting bolt 96 is provided in the collar 95. Thereby, the rubber bushings 94 are not pressed against the mounting bolt 96 when the mounting bolt 96 is tightened. Therefore, the mounting bolt 96 can be securely fastened to the embedded nut 97.

The mounting bolt 96 and the collar 95 surrounding the mounting bolt 96 extend in the horizontal direction (the direction orthogonal to the vertical plane including an axis of the cylinder 47*a*). The two cylindrical parts 93 surround the axial middle parts of the mounting bolt 96 and the collar 95, and are attached to the attachment bosses 11*a* via the mounting bolt 96 and the collar 95. The axes 90X of the fastening bolts 90 are orthogonal to the interface 46*b* (see FIG. 4) of the crankcase 46, and are orthogonal to the collar 95 and mounting bolt 96. Therefore, the collar 95 and the mounting bolt 96 at least partially overlap with the fastening bolts 90 when viewed in the axial direction of the fastening bolts 90. Therefore, the load transmitted from the engine 2 to the attachment bracket 91 via the fastening bolts 90 is linearly transmitted to the collar 95. Accordingly, the bending moment acting on the attachment bracket 91 becomes small, and the bending moment acting on the fastening bolts 90 and the screw holes 46*e* also becomes small. Therefore, it is possible to prevent the support stiffness in the rear lower portion support part 82 from being lowered.

The front lower portion support part 83 will be described. As shown in FIG. 4, an attachment bracket 71*a* is integrally formed on a lower portion of the fan cover 71. A pair of left and right attachment ribs 11*c* as mounting parts are formed on a lower front side of the case 11 and protrude upward from a front upper surface of the under cover 16. The attachment bracket 71*a* is elastically supported by the pair of left and right attachment ribs 11*c* via a mounting bolt 96 and a rubber bushing 94. The support structure of the attachment bracket 71*a* is substantially the same as the support structure of the attachment bracket 91.

As shown in FIGS. 4 and 5, when the user lifts the carrying handle 17 to carry the engine generator 1, most of the load of the power generation unit 4 including the engine 2 and the generator 3 is transmitted from the support plate 51*c* of the head cover 51 to the carrying handle 17 of the case 11 via the rubber bushings 85, the connecting pin 89, and the attachment bosses 11*a*. That is, the power generation unit 4 comes to be directly suspended from the carrying handle 17, so that it is not necessary to support the load of the power generation unit 4 by the case 11 itself. Accordingly, it is possible to reduce the thickness and weight of the case 11 that extends downward from the carrying handle 17. In addition, the flexibility in designing the shape and material of the case 11 is significantly increased.

As shown in FIG. 3, a front part of the under cover 16 that supports a lower front part of the power generation unit 4 is joined to a front part of the carrying handle 17 via the left and right reinforcement frames 26 having high stiffness. Therefore, the left side cover 12 and the right side cover 13 do not bear the load, but the carrying handle 17 bears the load dispersed back and forth. Therefore, it is possible to reduce the bending stress generated in the case 11 near the carrying handle 17.

On the other hand, in a state where the engine generator 1 is placed on the ground or the floor, most of the load of the power generation unit 4 is directly transmitted to the under cover 16 provided with the support legs 21. Therefore, even if the stiffness of the left side cover 12 and the right side cover 13 is set to be low, the deformation due to the load does not occur.

Further, the power generation unit 4 is elastically supported by the case 11 at three parts of the upper portion support part 81, the rear lower portion support part 82, and the front lower portion support part 83, so that the load of the power generation unit 4 is dispersed to each part of the case 11. Moreover, according to the vibration absorbing effect of the rubber bushings 85, 94, 94, it is possible to suppress not only the transmission of the vibration from the engine 2 to the carrying handle 17 but also the resonance of the case 11 due to the vibration of the engine 2.

In a state where the engine generator 1 is placed on the ground or the floor, the left side cover 12 and the right side cover 13 can be separated from the under cover 16 by simply removing the four bolts 29, 96. Therefore, the engine 2 and the generator 3 can be exposed and easily maintained without bedding the engine generator 1.

In the engine generator 1 of the present embodiment, the fastening bolts 90 that fasten the attachment bracket 91 to the crankcase 46 penetrate through the through holes 92*a* of the attachment bracket 91 and are screwed into the screw holes 46*e* formed obliquely inward at the corner of the bottom of the crankcase 46. Therefore, it is possible to enlarge the space inside the case 11 without lowering the support stiffness of the rear lower portion support part 82. That is, as shown by imaginary lines in FIG. 6, if the attachment bracket 91 protrudes horizontally rearward, the position of the attachment bracket 91 is relatively high and the space above the attachment bracket 91 is relatively small. On the other hand, with the above configuration, the attachment bracket 91 is displaced downward, and the space inside the case 11 is enlarged accordingly. Therefore, it is possible to increase the size of the muffler 61 arranged on an upper side of the attachment bracket 91 inside the case 11. Accordingly, it is possible to increase the size of the exhaust catalyst 62 and thereby to improve the exhaust purification performance without reducing the muffling effect of the muffler 61.

Concrete embodiments of the present invention have been described in the foregoing, but the present invention should not be limited by the foregoing embodiments and various modifications and alterations are possible. For example, in the above embodiments, the present invention is applied to the engine generator 1. However, the present invention may be applied to other engine power equipment such as an engine pump and a construction machine, or may be applied to an engine device including an engine for driving power equipment separated therefrom. Also, a specific configuration, an arrangement, quantity, an angle, and the like of each member and each portion thereof can be changed as appropriate within the scope of the present invention. Further, not all of the structural elements shown in the above embodiments are necessarily indispensable and they may be selectively adopted as appropriate.

Glossary of Terms

| | | | |
|---|---|---|---|
| 1: | engine generator (engine device) | | |
| 2: | engine | 3: | generator (power equipment) |
| 4: | power generation unit | 11: | case |
| 11b: | attachment ribs (mounting parts) | | |
| 11d: | support holes | 45: | crankshaft |
| 46: | crankcase | 46b: | interface |
| 46c: | upper half (first hall) | 46d: | lower half (second hall) |
| 46e: | screw hole | 61: | muffler |
| 62: | exhaust catalyst | 81: | upper portion support part |
| 82: | rear lower portion support part | | |
| 83: | front lower portion support part | | |
| 90: | fastening bolt | 90X: | axis |
| 91: | attachment bracket | 92: | main part |
| 92a: | through hole | 93: | cylindrical part |
| 93a: | attachment hole | 94: | rubber bushing |
| 95: | collar (mounting axial member) | | |
| 96: | mounting bolt (mounting axial member) | | |

The invention claimed is:

1. An engine device comprising:

an engine; and a case that accommodates the engine, wherein the engine includes a crankcase constituting a lower part thereof and is attached to the case via support parts, at least one of the support parts includes a mounting part provided in the case and an attachment bracket fastened to a bottom of the crankcase by a fastening bolt and attached to the mounting part, the fastening bolt penetrates through a through hole provided in the attachment bracket and screwed into a screw hole formed obliquely inward at a corner of the bottom of the crankcase, the crankcase includes a first half and a second half joined to each other by bolts on an interface formed obliquely with respect to a crank axis, and the second half is provided with the screw hole, and the screw hole is orthogonal to the interface.

2. The engine device according to claim 1, further comprising a muffler accommodating an exhaust catalyst and provided in a space defined between the case and a side of the engine where the attachment bracket is attached.

3. The engine device according to claim 1, wherein the attachment bracket is attached to the mounting part via a mounting axial member penetrating horizontally through an attachment hole provided in the attachment bracket and a support hole provided in the mounting part, and the mounting axial member at least partially overlaps with the fastening bolt when viewed in an axial direction of the fastening bolt.

4. The engine device according to claim 3, wherein the mounting part is provided at each of two ends of the mounting axial member, the attachment bracket includes two cylindrical parts surrounding a middle part of the mounting axial member between the two ends thereof, and each cylindrical part is supported by the mounting axial member via a rubber bushing provided between an outer circumference of the mounting axial member and an inner circumference of the cylindrical part.

5. The engine device according to claim 4, wherein the through hole is provided at a part of the attachment bracket between the two cylindrical parts.

6. The engine device according to claim 4, wherein the mounting axial member includes a mounting bolt and a collar surrounding the mounting bolt.

* * * * *